US008462181B2

(12) United States Patent
Li et al.

(10) Patent No.: US 8,462,181 B2
(45) Date of Patent: Jun. 11, 2013

(54) DRIVING METHOD AND DISPLAY DEVICE CAPABLE OF ENHANCING IMAGE BRIGHTNESS AND REDUCING IMAGE DISTORTION

(75) Inventors: Chung-Jian Li, Hsinchu County (TW); Tzung-Yuan Lee, Taichung County (TW); Shang-I Liu, Kaohsiung (TW); Chia-Hsin Tung, Hsinchu (TW); Hao-Jan Huang, Hsinchu (TW); Wing-Kai Tang, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 728 days.

(21) Appl. No.: 12/372,743

(22) Filed: Feb. 18, 2009

(65) Prior Publication Data

US 2010/0164998 A1 Jul. 1, 2010

(30) Foreign Application Priority Data

Dec. 26, 2008 (TW) ..... 97150996 A

(51) Int. Cl.
*G09G 5/10* (2006.01)
*G09G 3/36* (2006.01)

(52) U.S. Cl.
USPC ..... 345/690; 345/204; 345/87

(58) Field of Classification Search
USPC ..... 345/204, 690
See application file for complete search history.

(56) References Cited

U.S. PATENT DOCUMENTS

| | | | | |
|---|---|---|---|---|
| 6,166,781 | A * | 12/2000 | Kwak et al. | 348/674 |
| 6,856,306 | B2 * | 2/2005 | Ito | 345/89 |
| 7,002,594 | B2 * | 2/2006 | Yoshida et al. | 345/600 |
| 7,099,390 | B2 * | 8/2006 | Kajita | 375/240.12 |
| 7,111,028 | B2 * | 9/2006 | Sato | 708/204 |
| 7,319,464 | B2 * | 1/2008 | Yoneno | 345/204 |
| 7,777,759 | B2 * | 8/2010 | Yoshida et al. | 345/600 |
| 7,821,522 | B2 * | 10/2010 | Yoshida et al. | 345/600 |
| 8,040,337 | B2 * | 10/2011 | Nose et al. | 345/207 |
| 8,085,230 | B2 * | 12/2011 | Kim | 345/89 |
| 2001/0026283 | A1 * | 10/2001 | Yoshida et al. | 345/600 |
| 2002/0036650 | A1 * | 3/2002 | Kasahara et al. | 345/639 |
| 2003/0131038 | A1 * | 7/2003 | Sato | 708/606 |
| 2003/0137629 | A1 * | 7/2003 | Ichioka et al. | 349/149 |
| 2004/0155855 | A1 | 8/2004 | Chang | |
| 2005/0012700 | A1 | 1/2005 | Hara | |
| 2005/0270263 | A1 | 12/2005 | Kim | |
| 2006/0028484 | A1 * | 2/2006 | Yoshida et al. | 345/600 |
| 2006/0028485 | A1 * | 2/2006 | Yoshida et al. | 345/600 |
| 2006/0256051 | A1 * | 11/2006 | Lee et al. | 345/87 |
| 2007/0252795 | A1 * | 11/2007 | Shiomi | 345/87 |
| 2008/0084412 | A1 * | 4/2008 | Bae et al. | 345/212 |
| 2008/0117446 | A1 * | 5/2008 | Fukasawa | 358/1.9 |
| 2008/0309603 | A1 | 12/2008 | Feng | |
| 2009/0085924 | A1 * | 4/2009 | Ben-Chorin et al. | 345/591 |

* cited by examiner

*Primary Examiner* — Bipin Shalwala
*Assistant Examiner* — Afroza Chowdhury
(74) *Attorney, Agent, or Firm* — Winston Hsu; Scott Margo

(57) ABSTRACT

A driving method for a display device provides a first input pixel data corresponding to a pixel, and generates a second input pixel data by multiplying the first input pixel data by a predetermined rate. Next, an output pixel data corresponding to the second input pixel data is obtained from a predetermined gamma curve. When receiving the first input pixel data, the output pixel data is used for driving a display panel, and the second input pixel data is used for driving a backlight module of the display panel.

18 Claims, 6 Drawing Sheets

| $D_{p_i}$ | $K_i$ | $D_{f_i}$ (Floating-point) | $D_{o_i}$ (Integer) |
|---|---|---|---|
| 0 | 1.2 | 0 | 0 |
| 1 | | 1.2 | 1 |
| 2 | | 2.4 | 2 |
| 3 | | 3.6 | 4 |
| 4 | | 4.8 | 5 |
| 5 | | 6 | 6 |
| 6 | | 7.2 | 7 |
| 7 | | 8.4 | 8 |
| 8 | | 9.6 | 10 |
| 9 | | 10.8 | 11 |
| 10 | | 12 | 12 |
| 11 | | 13.2 | 13 |
| ⋮ | | ⋮ | ⋮ |
| 52 | 0.625 | 56.5 | 57 |
| 53 | | 57.125 | 57 |
| 54 | | 57.75 | 58 |
| 55 | | 58.375 | 58 |
| 56 | | 59 | 59 |
| 57 | | 59.625 | 60 |
| 58 | | 60.25 | 60 |
| 59 | | 60.875 | 61 |
| 60 | | 61.5 | 62 |
| 61 | | 62.125 | 62 |
| 62 | | 62.75 | 63 |
| 63 | | 63.375 | 63 |

FIG. 2 PRIOR ART

DRIVING METHOD AND DISPLAY DEVICE CAPABLE OF ENHANCING IMAGE BRIGHTNESS AND REDUCING IMAGE DISTORTION

BACKGROUND OF THE INVENTION

1. Field of the Invention

The present invention is related to a driving method and a related display device, and more particularly, to a driving method and a related display device capable of enhancing image brightness and reducing image distortion.

2. Description of the Prior Art

Liquid crystal displays (LCD), characterized in low radiation, small size and low power consumption, have gradually replaced traditional cathode ray tube (CRT) displays and been widely applied in various electronic devices, such as personal digital assistants (PDAs), flat-panel TVs or mobile phones. When used in portable electronic devices, battery duration is a major concern, but the backlight module of an LCD device consumes large amount of power. Therefore, many techniques capable of adjusting the brightness of the backlight module have been developed for power-saving purpose, commonly referred to as content adaptive backlight control (CABC) method. Although lowering the brightness of the backlight module can reduce power consumption, the overall brightness of the display images is also influenced. Therefore, the LCD device needs to enhance the brightness of the display images based on different image contents in order to maintain the image quality after performing the CABC technique.

In n-bit color depth display devices, each pixel has $2^n$ gray levels, each of which corresponds to a specific voltage level. In other words, various degrees of bright/dark visual performances can be achieved by driving each pixel with $2^n$ distinct voltage levels. Reference is made to FIG. 1 for a diagram illustrating the operation of a prior art n-bit color depth display device. Based on image signals, the prior art display device generates pixel data Dp_i for driving the backlight module, wherein i is an integer between 0 and n. Also, data slope is performed in which the pixel data Dp_i is multiplied by a predetermined rate Ki for generating corresponding pixel data Df_i. The pixel data Dp_i and Df_i can be related as follows:

$$Df_i=Ki*Dp_i;$$

where i represents gray level;

Ki is the predetermined rate corresponding to the $i_{th}$ gray level; and

Df_i is the pixel data of the $i_{th}$ gray level after performing data slope.

The relationship between the pixel data Dp_i and Df_i can be described by a partial-linear, non-linear or other specific transfer functions. However, all transfer functions aim at improving the brightness of the display images and only differ in the final effects. Since Ki is generally a floating-point value, the integer pixel data Dp_i are transformed into the floating-point pixel data Df_i after performing data slope. Since the digital-to-analog converter (DAC) of the display device only receives integer data, the floating-point pixel data Df_i have to be rounded off to the integer pixel data Do_i. Based on a predetermined gamma curve, the DAC converts the pixel data Do_i into analog voltages, thereby outputting the corresponding gamma voltage Vo_i for driving the display panel and the pixel data Dp_i for driving the backlight module.

Reference is made to FIG. 2 for a diagram illustrating the data slope operation in the prior art display device. In FIG. 2, the relationship between the pixel data Dp_i and Df_i can be described by a partial-linear transfer function, in which Ki equals to 1.2 for low gray levels and Ki equals to 0.65 for high gray levels. Since the DAC only receives integer data, the pixel data Do_i may lost a certain gray scale (such as when i=2 and i=3), causing unsmooth gray scale representation. Also, different pixel data Dp_i may be mapped to the same pixel data Do_i (such as when i=52 and i=53), causing loss in gray scale representation. Therefore, the display quality of the prior art display device is influenced due to image distortions.

SUMMARY OF THE INVENTION

The present invention provides a driving method capable of enhancing image brightness and reducing image distortion, comprising providing a first input pixel data corresponding to a pixel; generating a second input pixel data by multiplying the first input pixel data by a predetermined rate; obtaining an output pixel data corresponding to the second input pixel data from a predetermined gamma curve; and when receiving the first input pixel data, driving a display panel based on the output pixel data for displaying images and driving a light source of the display panel based on the first input pixel data.

The present invention also provides a driving method capable of enhancing image brightness and reducing image distortion, comprising providing a first input pixel data corresponding to a pixel; generating a second input pixel data by multiplying the first input pixel data by a predetermined rate; providing a first integer and a second integer if the second input pixel data is not an integer, wherein the first integer is the largest integer that is smaller than the second input pixel data and the second integer is the smallest integer that is greater than the second input pixel data; obtaining a first output pixel data corresponding to the first integer and a second output pixel data corresponding to the second integer from a predetermined gamma curve; obtaining a third output pixel data corresponding to the second input pixel data based on the first and second output pixel data; and when receiving the first input pixel data, driving a display panel based on the third output pixel data for displaying images and driving a light source of the display panel based on the first input pixel data.

The present invention also provides a display device capable of enhancing image brightness and reducing image distortion, comprising an image content analyzing circuit for generating a first input pixel data based on an image signal; an analog circuit for generating a second input pixel data by multiplying the input pixel data by a predetermined rate, for obtaining an output pixel data corresponding to the second input pixel data from a predetermined gamma curve, and for providing the output pixel data when receiving the first input pixel data; a display panel for displaying images corresponding to the first input pixel data based on the output pixel data; and a backlight module for providing light based on the first input pixel data.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 2 is a diagram illustrating the data slope operation in the prior art display device.

DETAILED DESCRIPTION

Figure 1:
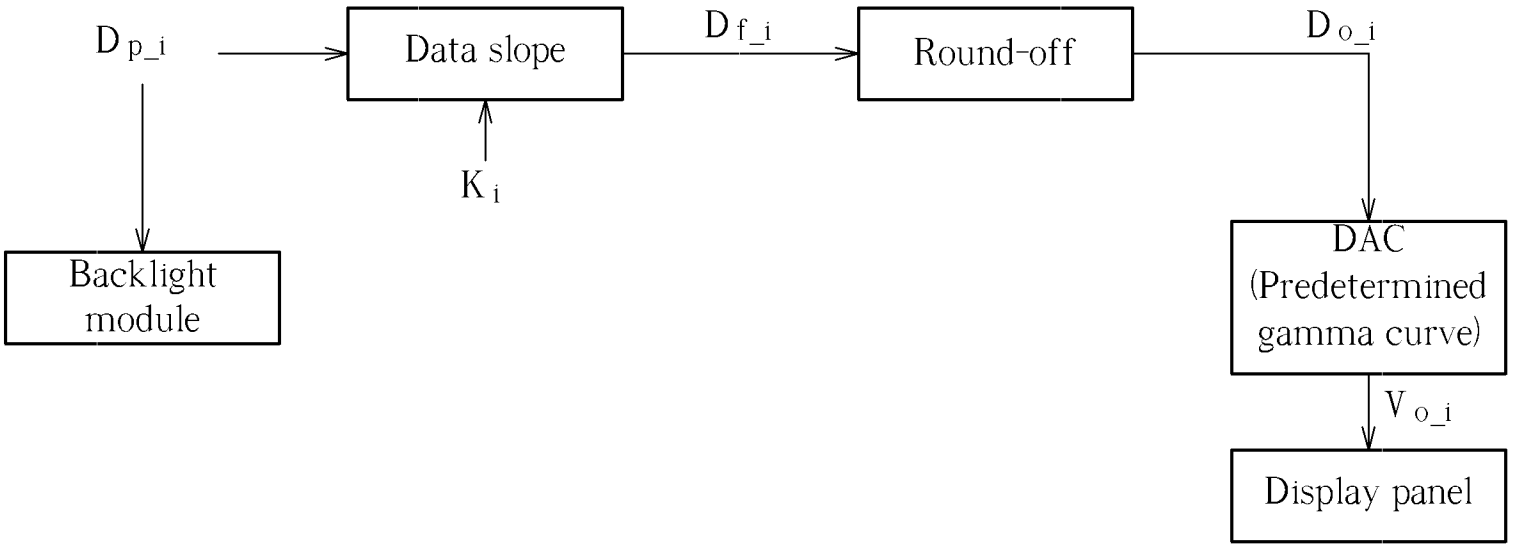
FIG. 1 PRIOR ART
FIG. 1 is a diagram illustrating the operation of a prior art n-bit color depth display device.
Figure 3:
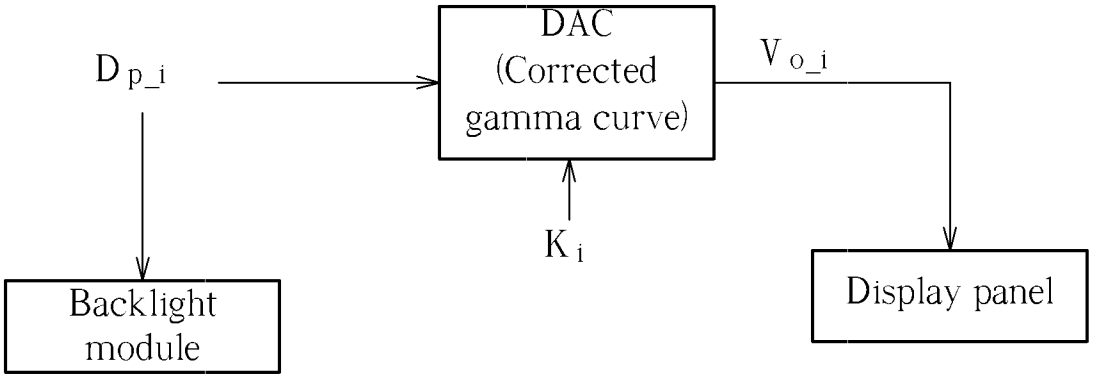
FIG. 3 is a diagram illustrating the operation of an n-bit color depth display device according to the present invention.

Reference is made to FIG. 3 for a diagram illustrating the operation of an n-bit color depth display device according to the present invention. Based on each pixel data Dp_i and its corresponding Ki, the present invention calculates the gamma voltage (the output voltage of the DAC) corresponding to each gray level without changing the input data of the DAC. In other words, the present invention directly acquires the relationship between the pixel data Df_i(Ki*Dp_i) and the gamma voltage Vo_i. Based on the corrected gamma curve, the gamma voltage Vo_i corresponding to each pixel data Dp_i is outputted for driving the display panel, while the backlight module is driven based on the pixel data Dp_i. Since no rounding-off is performed on the floating-point pixel data Df_i, the DAC receives $2^n$ distinct input values, each of which corresponds to $2^n$ distinct adjusted voltages. Therefore, the present invention can enhance the brightness of display images while retaining the complete variations in $2^n$ gray levels.

The method for acquiring the relationship between Dp_i and Vo_i will be described in the following paragraphs. In order for an LCD device to display images, external video signals are first converted into digital signals for image-processing, such as gamma correction or image size/chromatic aberration adjustments. Then the digital signals are converted into analog signals for driving the LCD panel. Regarding gamma correction, the gamma characteristic refers to the relationship between the input signal and the output brightness of a display device. Before delivered to the customer, the gamma characteristic of an LCD device has to be measured for gamma correction. Therefore, when driven based on the corrected gamma curve, the LCD device can perform according to various customer demands.

Figure 4:
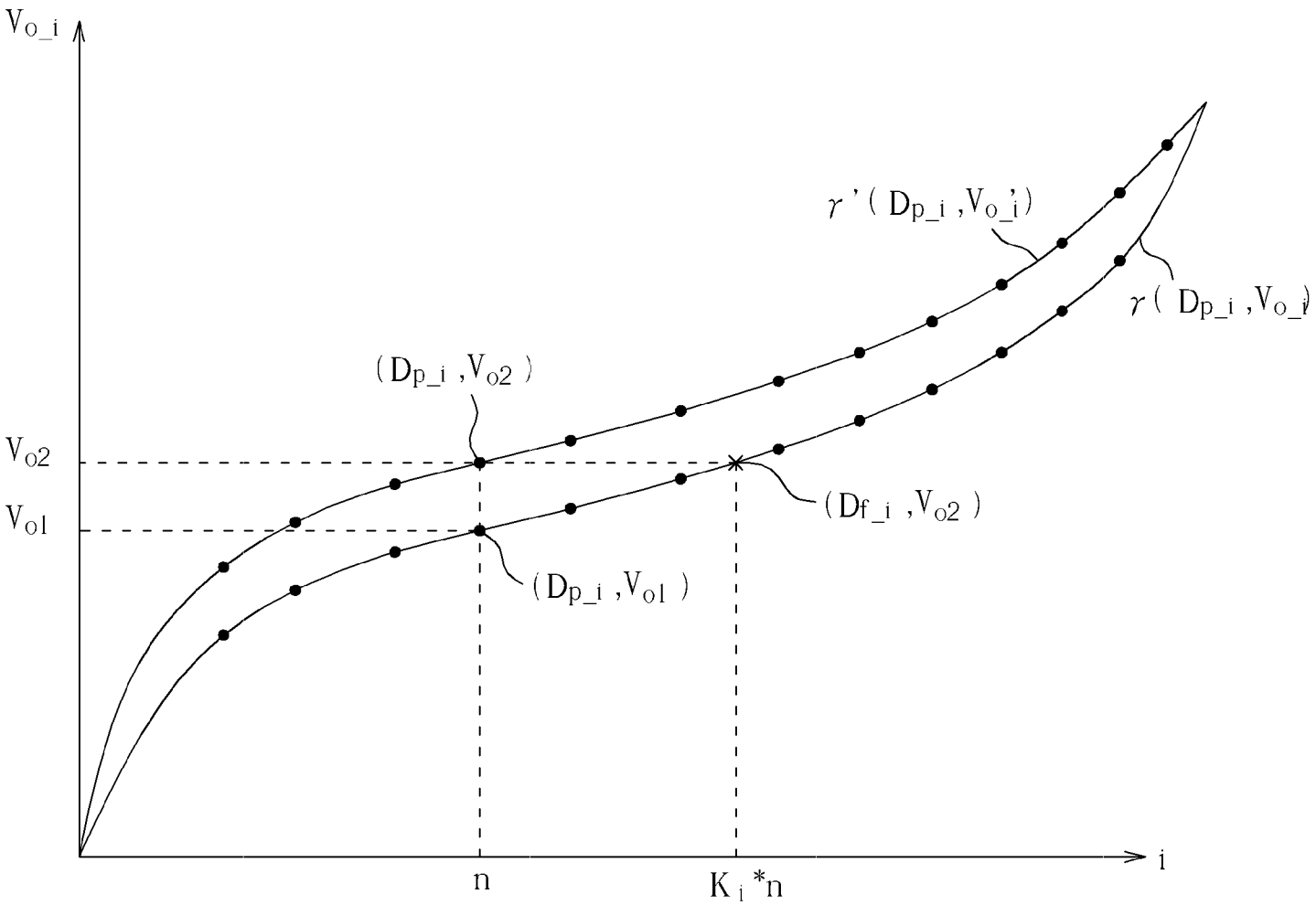
FIG. 4 is a diagram illustrating a method for driving an n-bit color depth display device according to a first embodiment of the present invention.

Reference is made to FIG. 4 for a diagram illustrating a method for driving an n-bit color depth display device according to a first embodiment of the present invention. FIG. 4 shows a predetermined gamma curve γ(Dp_i, Vo_i) and a corrected Gamma curve γ'(Dp_i, Vo_i') of the LCD device. The horizontal axle represents the gray scale i (ranging from 0 to $2^n$) of the input pixel data Dp_i, while the vertical axle represents the gamma voltage Vo_i. As depicted in FIG. 4, each integer input pixel data Dp_i can be mapped to a corresponding gamma voltage Vo_i based on the current gamma curve. Under normal operations, the backlight module of the LCD device provides the predetermined brightness, and the LCD device is driven based on the predetermined gamma curve γ.

When the brightness provided by the backlight module is lowered for reducing power consumption, the present invention drives the display device based on the corrected gamma curve γ' in order to maintain the overall brightness of the display images. Using the concept of data slope for explanation, the display device of the present invention is required to achieve the display effects of the input pixel data Df_i (Ki*Dp_i) when receiving the input pixel data Dp_i. Although the input pixel data Dp_i may have floating-point values, each can be mapped to a corresponding gamma voltage Vo_i based on the predetermined gamma curve γ. For example, assuming the value of the predetermined gamma curve γ equals to $V_{O1}$ when the gray scale i of the input pixel data Df_i equals to n, and the display device is required to achieve the display effects when the gray scale of the input pixel data Df_i equals to Ki*n. Ki*n can be mapped to a corresponding gamma voltage $V_{O2}$ based on the predetermined gamma curve γ, no matter Ki*n is an integer or a floating-point. The gamma voltage $V_{O2}$ can be used as the corrected gamma voltage Vo_i' when receiving the input pixel data Dp_i having a gray scale of n. Therefore, based on each input pixel data Dp_i and its corresponding Ki, the gamma voltage corresponding to Ki*Dp_i obtained from the predetermined gamma curve γ can be used as the corrected gamma voltage Vo_i'. Thus, the corrected gamma curve γ' can be obtained based on the input pixel data Dp_i and the corrected gamma voltage Vo_i'. When the brightness provided by the backlight module is lowered for reducing power consumption, the present invention drives the display device based on the corrected gamma curve γ' in order to maintain the overall brightness of the display images at a level similar to that when driven based on the predetermined gamma curve γ.

Figure 5:
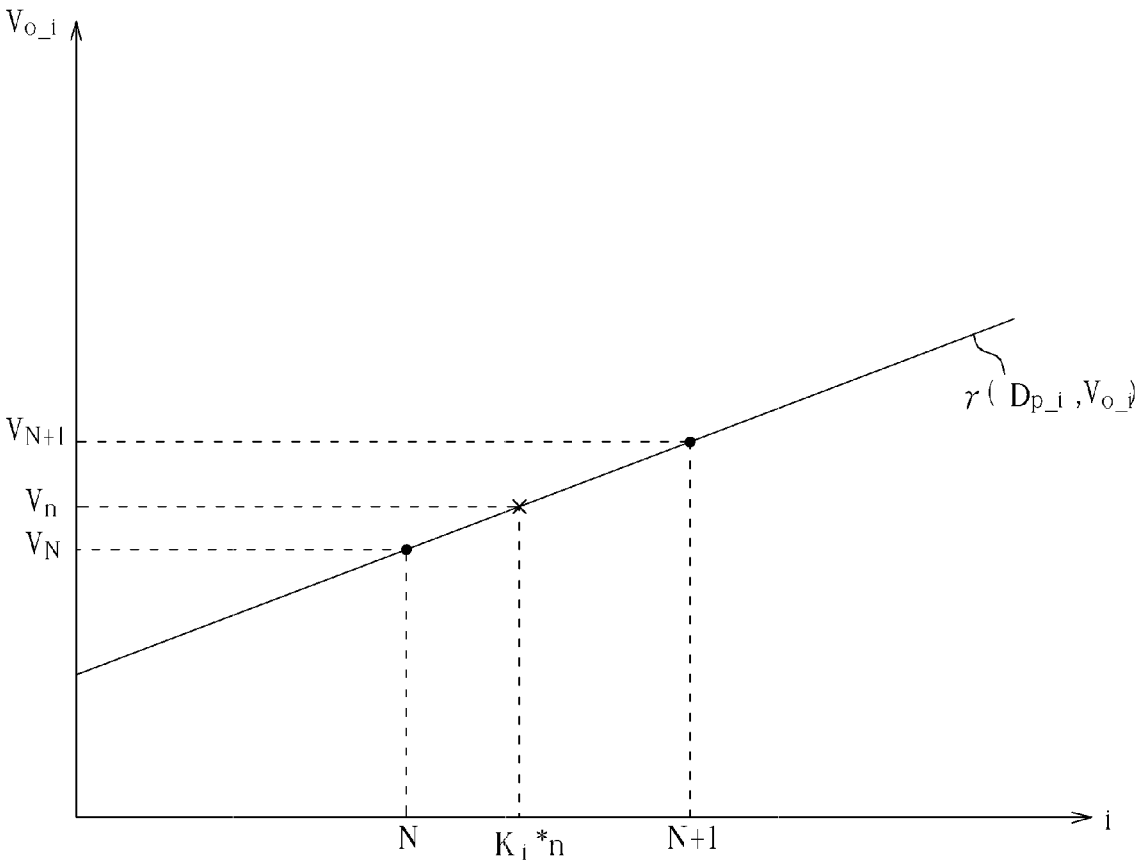
FIG. 5 is a diagram illustrating a method for driving an n-bit color depth display device according to a second embodiment of the present invention.

Reference is made to FIG. 5 for a diagram illustrating a method for driving an n-bit color depth display device according to a second embodiment of the present invention. FIG. 5 shows a partially-enlarged diagram of a predetermined gamma curve γ(Dp_i, Vo_i) of the LCD device. The horizontal axle represents the gray scale i (ranging from 0 to $2^n$) of the input pixel data Dp_i, while the vertical axle represents the gamma voltage Vo_i. Also using the concept of data slope for explanation, the display device of the present invention is required to achieve the display effects of the input pixel data Df_i(Ki*Dp_i) when receiving the input pixel data Dp_i, wherein the input pixel data Dp_i may be an integer or a floating-point. If the input pixel data Dp_i is an integer, a corresponding gamma voltage Vn is obtained from the predetermined gamma curve γ. If the input pixel data Dp_i is a floating-point, two adjacent integers N and N+1 are obtained, which are respectively mapped to corresponding gamma voltages $V_N$ and $V_{N+1}$ based on the predetermined gamma curve γ. Based on the gamma voltages $V_N$ and $V_{N+1}$, a corresponding gamma voltage Vn can be obtained by means of interpolation. Vn can be represented as follows:

$$Vn=(V_N-V_{N+1})n-N(V_N-V_{N+1})+V_N$$

In the second embodiment of the present invention, the gamma voltage Vn obtained by means of interpolation is directly outputted for driving the display panel when receiving the input pixel data Dp_i. When the brightness provided by the backlight module is lowered for reducing power consumption, the present invention can still maintain the overall brightness of the display images.

Figure 6:
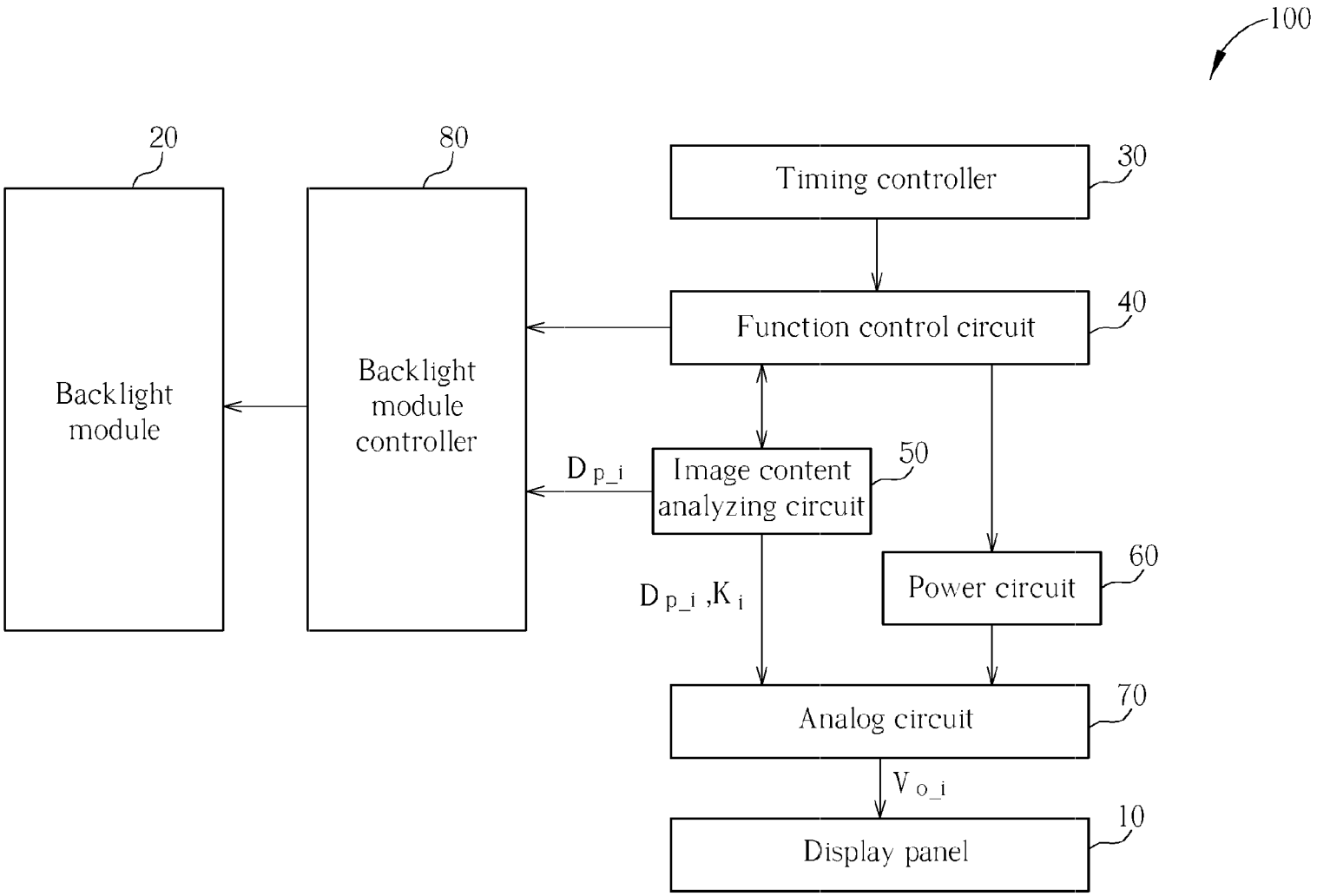
FIG. 6 is a diagram illustrating an n-bit color depth display device according to the present invention.

Reference is made to FIG. 6 for a diagram illustrating an n-bit color depth display device 100 according to the present invention. The display device 100 includes a display panel 10, a backlight module 20, a timing controller 30, a function controller 40, an image content analyzing circuit 50, a power circuit 60, an analog circuit 70, and a backlight control circuit 80. The display panel 10 can includes LCD panels, light emitting diode (LED) panels, or organic light emitting diode (OLED) panels. The timing controller 30 can generate data signals, command signals and control signals for operating the display device 100. The function controller 40 includes random access memory (RAM), registers and other components. The power circuit 60 includes regulators, bandgap circuits and charge pumps. The analog circuit 70 includes DACs, gamma circuits, buffers and power amplifiers. The image content analyzing circuit 50 can analyze the image signals received from the timing controller 30, thereby generating the pixel data Dp_i for driving the backlight module 20. Based on the pixel data Dp_i and ki, the analog circuit 70 can output the corresponding gamma voltage Vo_i for driving the display panel.

In the prior art display device, data slope is performed for acquiring new floating-point gray scales, which need to be rounded off into integers before being inputted to the DAC. Due to the limitation of DAC, image distortions may occur. In the present invention, each gray scale is mapped to a corresponding Vo_i (the output voltage of DAC) based on different Ki. In other words, the relationship between Dp_i and Vo_i is directly obtained instead of changing the input voltage of DAC. Since no rounding-off is performed on the floating-point pixel data Df_i, the present invention can reduce power consumption and maintain the overall brightness of display images while retaining the complete variations in $2^n$ gray levels.

Those skilled in the art will readily observe that numerous modifications and alterations of the device and method may be made while retaining the teachings of the invention.

What is claimed is:

1. A driving method capable of enhancing image brightness and reducing image distortion, comprising:

providing a first input pixel data corresponding to a pixel;

generating a second input pixel data by multiplying the first input pixel data by a predetermined rate;

directly applying the second input pixel data to a first gamma curve without rounding off the second input pixel data to integer data if the second input pixel data is floating-point data for obtaining a corresponding output pixel data; and when receiving the first input pixel data, driving a display panel based on the output pixel data for displaying images and driving a light source of the display panel based on the first input pixel data.

2. The driving method of claim 1 further comprising:

providing a plurality of first input pixel data corresponding to all gray scale variations of the pixels;

generating a plurality of second input pixel data by respectively multiplying the plurality of first input pixel data by corresponding predetermined rates;

obtaining a plurality of output pixel data respectively corresponding to the plurality of second input pixel data from the first gamma curve; and providing a second gamma curve based on relationships between the plurality of input pixel data and the corresponding plurality of first input pixel data.

3. The driving method of claim 2 further comprising:

driving the display panel based on the second gamma curve for displaying the images when receiving the plurality of first input pixel data.

4. The driving method of claim 1 wherein generating the second input pixel data by multiplying the first input pixel data by the predetermined rate includes generating the second input pixel data by multiplying the first input pixel data by the predetermined rate having a floating-point value.

5. A driving method capable of enhancing image brightness and reducing image distortion, comprising:

providing a first input pixel data corresponding to a pixel;

generating a second input pixel data by multiplying the first input pixel data by a predetermined rate;

providing a first integer and a second integer if the second input pixel data is not an integer, wherein the first integer is the largest integer that is smaller than the second input pixel data and the second integer is the smallest integer that is greater than the second input pixel data;

directly applying the first integer to a first gamma curve for obtaining a corresponding first output pixel data without rounding off the second input pixel data to integer data if the second input pixel data is floating-point data;

directly applying the second integer to the first gamma curve for obtaining a corresponding second output pixel data without rounding off the second input pixel data to integer data if the second input pixel data is floating-point data;

obtaining a third output pixel data corresponding to the second input pixel data based on the first and second output pixel data; and when receiving the first input pixel data, driving a display panel based on the third output pixel data for displaying images and driving a light source of the display panel based on the first input pixel data.

6. The driving method of claim 5 further comprising:

obtaining a fourth output pixel data corresponding to the second input pixel data from the first gamma curve if the second input pixel data is an integer; and when receiving the first input pixel data, driving the display panel based on the fourth output pixel data for displaying images.

7. The driving method of claim 5 wherein generating the second input pixel data by multiplying the first input pixel data by the predetermined rate includes generating the second input pixel data by multiplying the first input pixel data by the predetermined rate having a floating-point value.

8. A display device capable of enhancing image brightness and reducing image distortion, comprising:

an image content analyzing circuit for generating a first input pixel data based on an image signal;

an analog circuit for generating a second input pixel data by multiplying the input pixel data by a predetermined rate, for directly applying the second input pixel data to a first gamma curve without rounding off the second input pixel data to integer data if the second input pixel data is floating-point data for obtaining a corresponding output pixel, and for providing the output pixel data when receiving the first input pixel data;

a display panel for displaying images corresponding to the first input pixel data based on the output pixel data; and a backlight module for providing light based on the first input pixel data.

9. The display device of claim 8, further comprising:

a timing controller for providing the image signal;

a function control circuit for storing data signals and control signals;

a power circuit for providing operational voltages of the display device; and a backlight module controller for controlling the backlight module based on the first input pixel data.

10. The display device of claim 9 wherein the function control circuit includes a random access memory (RAM) and a register.

11. The display device of claim 9 wherein the power circuit includes a regulator, a bandgap circuit and a charge pump.

12. The display device of claim 8 wherein the analog circuit includes a digital-to-analog converter (DAC), a gamma circuit, a buffer and a power amplifier.

13. A driving method capable of enhancing image brightness and reducing image distortion, comprising:

providing a first input pixel data corresponding to a pixel;

obtaining an output gamma voltage from a second gamma curve according to the first input pixel data, wherein the second gamma curve is obtained according to a predetermined rate associated with a first gamma curve and the first input pixel data; and when receiving the first input pixel data, driving a display panel based on the output gamma voltage for displaying images and driving a light source of the display panel based on the first input pixel data.

14. The driving method of claim 13 further comprising:

providing a plurality of first input pixel data corresponding to a plurality of gray scale variations of the pixels;

generating a plurality of second input pixel data by respectively multiplying the plurality of first input pixel data by corresponding predetermined rates;

obtaining a plurality of output gamma voltages respectively corresponding to the plurality of second input pixel data from the first gamma curve; and providing the second gamma curve based on relationships between the plurality of output gamma voltages and the corresponding plurality of first input pixel data.

15. The driving method of claim 13 further comprising:

applying the second gamma to a DAC.

16. The driving method of claim 14 wherein generating the second input pixel data by multiplying the first input pixel data by the predetermined rate includes generating the second input pixel data by multiplying the first input pixel data by the predetermined rate having a floating-point value.

17. A display device capable of enhancing image brightness and reducing image distortion, comprising:

an image content analyzing circuit for generating a first input pixel data based on an image signal;

an analog circuit including a DAC configured to obtain an output gamma voltage from a second gamma curve according to the first input pixel data, wherein the second gamma curve is obtained according to a predetermined rate associated with a first gamma curve and the first input pixel;

a display panel for displaying images corresponding to the first input pixel data based on the output gamma voltage; and a backlight module for providing light based on the first input pixel data.

18. The display device of claim 17, wherein the DAC is further configured to receive a plurality of first input pixel data corresponding to a plurality of gray scale variations of the pixels, generate a plurality of second input pixel data by respectively multiplying the plurality of first input pixel data by corresponding predetermined rates, obtain a plurality of output gamma voltages respectively corresponding to the plurality of second input pixel data from the first gamma curve, and provide the second gamma curve based on relationships between the plurality of output gamma voltages and the corresponding plurality of first input pixel data.

* * * * *